US009408433B2

(12) United States Patent
Battilana

(10) Patent No.: US 9,408,433 B2
(45) Date of Patent: Aug. 9, 2016

(54) SPORT FOOTWEAR SUCH AS A SKI BOOT OR SUCHLIKE

(71) Applicant: DAL BELLO HOLDING S.R.L., Treviso (IT)

(72) Inventor: Carletto Battilana, Treviso (IT)

(73) Assignee: CALZATURIFICIO DAL BELLO S.R.L., Treviso (IT)

( * ) Notice: Subject to any disclaimer, the term of this patent is extended or adjusted under 35 U.S.C. 154(b) by 623 days.

(21) Appl. No.: 13/902,581

(22) Filed: May 24, 2013

(65) Prior Publication Data

US 2013/0312289 A1 Nov. 28, 2013

(30) Foreign Application Priority Data

May 25, 2012 (IT) ..... UD2012A0097

(51) Int. Cl.
*A43B 5/04* (2006.01)

(52) U.S. Cl.
CPC ..... *A43B 5/0427* (2013.01); *A43B 5/0456* (2013.01); *A43B 5/0474* (2013.01)

(58) Field of Classification Search
CPC .... A43B 5/0427; A43B 5/0429; A43B 5/045; A43B 5/0474
USPC ..... 36/118.2, 118.9
See application file for complete search history.

(56) References Cited

U.S. PATENT DOCUMENTS

| | | | | |
|---|---|---|---|---|
| 4,265,034 | A | 5/1981 | Salomon | |
| 4,761,899 | A * | 8/1988 | Marxer | A43B 5/0433 36/105 |
| 5,588,229 | A * | 12/1996 | Marmonier | A43B 5/04 36/118.2 |
| 6,453,580 | B1 | 9/2002 | Lancon | |
| 6,530,161 | B1 | 3/2003 | Bauvois | |
| 2008/0141561 | A1* | 6/2008 | Battilana | A43B 5/0474 36/50.5 |
| 2012/0198725 | A1* | 8/2012 | Sartor | A43B 5/0474 36/132 |
| 2014/0013629 | A1* | 1/2014 | Haugen | A43B 5/0456 36/117.1 |

FOREIGN PATENT DOCUMENTS

| | | |
|---|---|---|
| DE | 1932776 A1 | 1/1971 |
| DE | 2404447 A1 | 8/1974 |

OTHER PUBLICATIONS

Italian Search Report dated Feb. 27, 2013, as issued in corresponding Italian Patent Application No. US20120097, filed May 25, 2012.

* cited by examiner

*Primary Examiner* — Ted Kavanaugh
(74) *Attorney, Agent, or Firm* — Maier & Maier, PLLC

(57) ABSTRACT

A sport footwear comprises a lower part or shell to contain the foot, and an upper part or cuff to contain and surround the joint of the ankle and the lower part of the leg. The cuff and shell are pivoted with respect to each other. A clamping device is provided for the reciprocal clamping of the cuff and the shell at least in a first clamped position and a second unclamped position, in which the free oscillatory movement of cuff and shell is allowed.

13 Claims, 5 Drawing Sheets

SPORT FOOTWEAR SUCH AS A SKI BOOT OR SUCHLIKE

RELATED APPLICATION

This application claims priority under 35 U.S.C. §119 to Italian Patent Application No. UD2012A000097filed May 25, 2012, the disclosure of which is incorporated by reference herein in its entirety.

FIELD OF THE INVENTION

The present invention concerns a sport footwear, such as for example a ski boot or suchlike, having a clamping device which, in the configuration between a first closed and clamped position, used when the sport is being practiced and also called "skiing position", and a second unclamped position that facilitates walking, also called "walking position", makes the boot more comfortable during pauses of non-activity and when the boot is put on/removed.

BACKGROUND OF THE INVENTION

It is known that in rigid sport footwear with a central entrance, such as for example ski boots, whether for Alpine skiing, snowboarding or suchlike, the cuff and the shell are pivoted to each other in correspondence with the malleolar zone of the foot, and can assume a first clamped position for use during sport, to clamp the ankle during activity, and a second, unclamped position to facilitate walking, putting on and removing the boot.

Such boots are provided with clamping and unclamping devices which allow to modify the reciprocal coupling condition of the cuff and shell.

Known clamping and unclamping devices normally consist, however, of complex and bulky mechanisms that use gears, tie rods, pins or keys: this entails an increase in the production costs of the boot, laborious maneuvers and exposure to wear, with the risk of accidental unclamping.

The patents IT-B-1.336.330, IT-B-1.369.969, IT-B-1.370.304, IT-B-1.374.307, IT-B-1.370.337 and IT-B-1.389.364 in the name of the present Applicant are also known. These describe improved solutions to the state of the art, where generally a stop element or strut is provided, mounted on the cuff by pivoting or sliding. The stop element is mobile between a first clamped position, in which it cooperates with a clamping surface of the shell to keep the cuff in a determinate clamped position with respect to the shell, and a second unclamped position, in which it is freed from the clamping surface of the shell, to allow the cuff to oscillate freely with respect to the shell.

The passage of the strut between the first and the second position is normally determined by manual action on a respective lever element protruding from the cuff and connected to the strut by means of various types of drive kinematisms, which are particularly complex and costly since they are formed by a high number of components which must be assembled, which are delicate and therefore subject to breakage, where one or more elastic means are typically used, such as torsional springs or return springs that facilitate the passage between the two positions described above.

Document DE-A-2.404.447 describes a ski boot that provides an elastic sheet associated with the cuff by means of an additional assembly block, and a lever anchored to the shell, with a clamping function in several positions, but which does not intervene in the clamping operation, acting directly on the elastic sheet.

Document U.S. Pat. No. 6,453,580 describes a cross-country skiing boot which provides a lever anchored to the cuff which, acting on a cable, puts under traction an extension in the cuff, which functions as an elastic element for absorbing impacts, and modifies its set-up.

Purpose of the present invention is to obtain a sport footwear that is simple and economical to produce, which can be put on and removed easily, and which solves the problems present in the state of the art, in particular obtaining a clamping device that is simple, reliable and formed by a limited number of components, so as to reduce production costs and also the possibility of breakage and hence the costs and frequency of repairs.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purpose, a sport footwear according to the present invention comprises a lower part or shell to contain the foot, and an upper part or cuff to contain and surround the ankle joint and the lower part of the leg. Cuff and shell are pivoted to each other, and a clamping device is provided for the reciprocal clamping of the cuff and shell at least in a first clamped position and a second unclamped position, which allows the free oscillatory movement of cuff and shell.

According to the present invention, the clamping device comprises an elastic metal sheet that develops longitudinally along the external rear surface of the cuff and configured to function as a selective clamping element of the reciprocal angular position of cuff and shell. In this way, the elastic metal sheet functions both as a physical clamping element and also, thanks to the elastic properties of the material of which it consists, itself defines the necessary elastic behavior for the reversible passage from one to the other of the first and second positions. This allows to obtain a clamping device that is simple, reliable and formed by a limited number of components, thus reducing production costs, and also the possibility of breakages and hence the costs and frequency of repairs.

In some forms of embodiment, the elastic metal sheet is anchored directly to and on the cuff. One advantage of the present invention is that the elastic metal sheet, since it is applied directly on the cuff, simplifies assembly and does not require additional assembly components or blocks.

In some forms of embodiment, the elastic metal sheet has at least a free lower end for selective clamping.

In a variant form of embodiment, the elastic metal sheet is shaped like a metal tape or strip, with an oblong development and a thin thickness and is made using a metal with elastic properties, including harmonic steel for springs.

In one form of embodiment, the elastic metal sheet has an upper attachment end, stably constrained to an upper segment of the rear surface of the cuff and the lower end is free, that is, it is not attached to the cuff but can cooperate with the shell for the selective clamping of cuff and shell. The free lower end is configured to be elastically deformed between the first clamped position, displaced toward the inside of the cuff, in which it constrains the reciprocal movement of cuff and shell, and the second unclamped position, displaced toward the outside of the cuff, in which it allows the oscillation of cuff and shell.

In a variant form of embodiment, the clamping device comprises a stepped stopping surface that delimits a shaped clamping seating mating with the lower end, in which the stepped stopping surface and the lower end cooperate in the first clamped position.

In another variant, the clamping device comprises attachment means to constrain the upper end of the elastic metal sheet to the upper segment of the rear surface of the cuff, which include mechanical attachment means or means to adjust the rigidity of the cuff.

In one form of embodiment, the clamping device is provided with a command mechanism associated externally with the cuff and configured to condition the position of the elastic metal sheet and thus to take it from the first clamped position to the second unclamped position and vice versa.

In variant forms of embodiment, the command mechanism comprises a lever configured to cooperate with the cuff and to act on the elastic metal sheet so as to provide it with a position in which the lower end is distant from and does not cooperate with the shell, and a position in which the lower end cooperates with the stepped stopping surface. In substance, the elastic metal sheet can have two positions, a work position, in which it cooperates with the stepped stopping surface, and a position where the cuff is free. This double position is conditioned by the lever which, depending on the case, can be anchored, for example pivoted, to the elastic metal sheet or to the cuff. One possible advantage of the present invention is that, thanks to the lever, the elastic metal sheet cannot change the position desired by the user, even accidentally. Moreover, another advantage is that the lever acts directly on the elastic sheet and does not need to be positioned with respect thereto.

In some variants, the elastic metal sheet is the only element making up the clamping device that is able to cooperate with the stepped stopping surface.

In other variants, the elastic metal sheet is coupled with a stop element or strut, disposed substantially longitudinally along the external rear surface of the cuff, selectively mobile solidly with the elastic metal sheet between a first clamped position, in which it reciprocally clamps the cuff and shell, and a second unclamped position, displaced toward the outside of the cuff with respect to the first position, in which it allows the free oscillatory movement of the cuff with respect to the shell.

BRIEF DESCRIPTION OF THE DRAWINGS

These and other characteristics of the present invention will become apparent from the following description of forms of embodiment, given as a non-restrictive example with reference to the attached drawings wherein.

Figure 3:
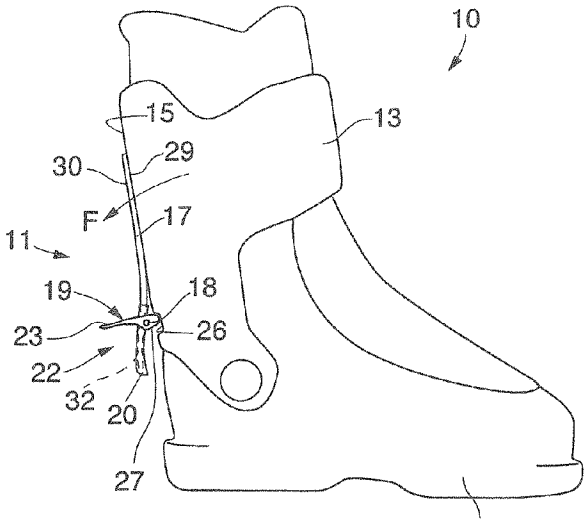
FIG. 3 is a schematic lateral view of a boot according to the present invention in a second unclamped position of use.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF FORMS OF EMBODIMENT

With reference to the attached drawings, a sport footwear according to the present invention is indicated in its entirety by the number 10, in this case a ski boot.

Figure 2:
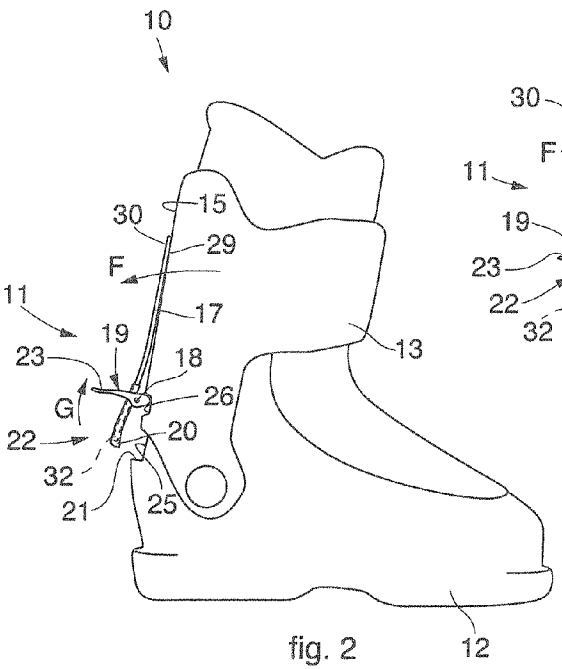
FIG. 2 is a schematic lateral view of a boot according to the present invention in the first clamped position of use, with the clamping device open.
Figure 1:
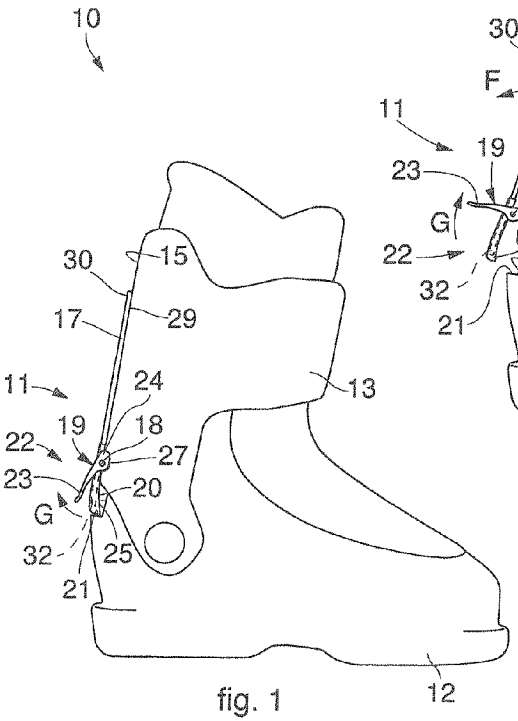
FIG. 1 is a schematic lateral view of a boot according to the present invention in a first clamped position of use.
Figure 4:
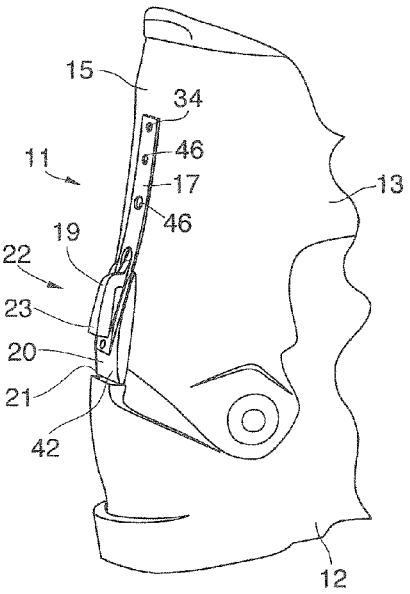
FIGS. 4 and 5 are partial perspective views of a variant of the boot according to the present invention in two adjustable conditions of use of the clamping device.
Figure 5:
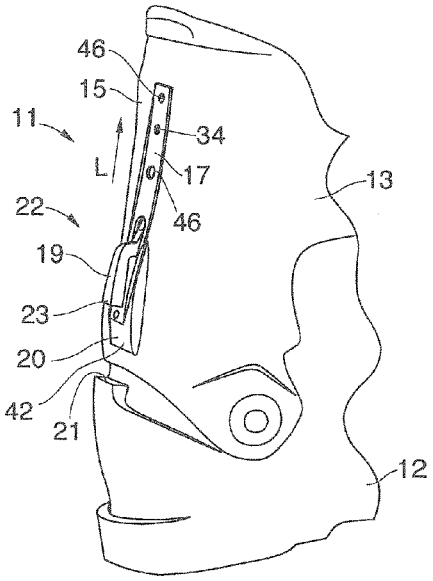

The footwear 10 comprises a rigid lower part or shell 12, inside which the foot of the user is disposed, and an upper part, or cuff 13, which is also rigid, to contain and surround the joint of the ankle and the lower part of the leg, substantially as far as the calf of the user (FIGS. 1-3).

The cuff 13 is pivoted to the shell 12 on a pivoting axis disposed in correspondence to the malleolar zone and is therefore able to partly oscillate with respect to the shell 12.

The sport footwear 10 also comprises closing elements of the substantially known type, not shown here.

The traditional operations to open and close the closing elements respectively determine an open condition and a closed condition of the sport footwear 10, and thus allow the user to put it on, remove it and use it correctly.

The sport footwear 10 is also provided with a clamping device 11 disposed on an external rear surface 15 of the cuff 13 (FIGS. 1-3) to reciprocally clamp the cuff 13 and the shell 12, in particular in a first clamped position and a second unclamped position, in which the free oscillatory movement of the cuff 13 with respect to the shell 12 is allowed.

The clamping device 11 comprises an elastic metal sheet 17 which develops longitudinally along the external rear surface 15 of the cuff 13 and that, thanks to the elastic and mechanical properties of the material of which it is made, acts as a selective clamping element of the reciprocal angular position of the cuff 13 and the shell 12.

The elastic metal sheet 17 has an upper end 30, stably constrained to the rear surface 15 of the cuff 13, in particular an upper segment 29 thereof. For example, the constraint of the upper end 30 is achieved by means of attachment means 34, such as welding, or of the mechanical type such as a rivet, a peg or comparable attachment component, or by means of a more complex adjustment mechanism, as will be explained in more detail hereafter.

Moreover, the elastic metal sheet 17 has a free lower end 32, configured to be elastically deformed to cooperate selectively at least with the shell 12 to determine the clamping of the angular position of the shell 12 and the cuff 13.

Thanks to the elastic properties of the elastic metal sheet 17, the lower end 32 can be moved in an elastically reversible way between a first clamped position, displaced toward the inside of the cuff 13, in which it constrains the reciprocal movement of the cuff 13 and the shell 12, and a second unclamped position, displaced toward the outside of the cuff 13, in which it allows the oscillation of the cuff 13 and the shell 12.

In particular, to achieve this the shell 12 comprises, in a coordinated manner, at least a stepped stopping surface, or stopping step, or shoulder 21, which delimits a clamping seating 25, made on the shell 12 in correspondence to the lower end 32 and against which the lower end 32, directly or indirectly, stably rests when it is in the first clamped position. Moreover, also the lower part of the cuff 13 can rest, in the second unclamped position, on the stepped stopping surface, or shoulder 21 (FIG. 3).

The clamping device 11 is also provided with a command mechanism 22 associated externally to the cuff 13, by means of which the user can condition the position of the elastic metal sheet 17 and thus take the lower end 32 from its first clamped position to the second unclamped position.

Since the elastic metal sheet 17 is constrained to the upper segment 29 of the cuff 13, which functions as a fixed abutment, a stress applied toward the outside by the command mechanism 22 on the lower end 32 determines the local elastic deformation of the elastic metal sheet 17, displacing it toward the outside so as to release it from the stepped stopping surface or shoulder 21, and therefore to unconstrain the oscillation of the cuff 13 and shell 12. Thanks to the elastic thrust of the elastic metal sheet 17, this configuration allows the reversible and substantially automatic return of the lower end 32 from the second position to the first position.

In particular, FIG. 1 shows the footwear 10 in the first clamped position, with the clamping device closed, while in FIG. 2, again in the first clamped position, the clamping device 11 is open to allow rotation into the second unclamped position which is shown in FIG. 3, as indicated by the arrows F.

The elastic metal sheet 17 is shaped with an oblong development and a limited or thin thickness and is made of a metal with good elastic properties, for example harmonic steel for springs or other similar material.

Thanks to the combination of length, reduced thickness and material that makes it up, the elastic metal sheet 17 has a capacity for bending and for elastic deformation that is sufficient to satisfy the requirements of displacement of the lower end 32 between the first clamped position, used when practicing sport, and the second unclamped position, for putting on/removing the boot or for walking.

Furthermore, thanks to its structural and mechanical properties, the elastic metal sheet 17 is suitable to support the reciprocal thrust of cuff 13 and shell 12 which acts on the lower end 32 in the first clamped position, guaranteeing stability and safety during sporting activity.

In a basic solution, the elastic metal sheet 17 is the only element making up the clamping device 11 that is able to cooperate with the stepped stopping surface or shoulder 21, and to selectively determine the displacement and clamping of the cuff 13 with respect to the shell 12.

In another form of embodiment instead, the lower end 32 of the elastic metal sheet 17 is coupled with a stop element or strut 20, which can have variable shapes and sizes and functional purposes, also for aesthetic ends.

In particular, in this variant, the lower end 32 of the elastic metal sheet 17 is constrained stably and solidly to the strut 20.

The strut 20 is disposed substantially longitudinally along the external rear surface 15 of the cuff 13, in particular along the lower segment 28 thereof.

In the same way as the lower end 32 to which it is constrained, the strut 20 is able to be selectively moved between a first clamped position, in which it reciprocally clamps the cuff 13 and shell 12, and a second unclamped position, displaced toward the outside of the cuff 13 with respect to the first position, in which it allows the free oscillatory movement of the cuff 13 with respect to the shell 12.

In this form of embodiment, the elastic metal sheet 17, attached to the upper segment 29 of the cuff 13, is therefore operationally connected to the strut 20, thrusting it positively toward the inside and tending to keep it normally toward its first clamped position. Thanks to the elastic thrust, this configuration allows the reversible and substantially automatic return of the strut 20 from the second position to the first position.

In this form of embodiment, it is the strut 20, constrained to the lower end 32, which rests with a lower end 42 directly against the stopping surface 21 in the first clamped position, in which the reciprocal rotation of cuff 13 and shell 12 is contrasted, keeping them clamped.

On the contrary, thanks to the elastic deformation of the elastic metal sheet 17, when the strut 20 is released from the stopping surface 21 in its second unclamped position, the strut 20 moves with its lower end 42 toward the outside of the shell 12, freeing the movement of reciprocal rotation of cuff 13 and shell 12.

In a variant, the lower end 32 of the elastic metal sheet 17 can be attached, for example overlapping, to the strut 20 (FIGS. 4, 5, 9 and 10).

In another variant, the lower end 32 of the elastic metal sheet 17 can be incorporated at least partly in the strut 20.

In yet another variant, the lower end 32 of the elastic metal sheet 17 can be at least partly drowned in the strut 20 (FIGS. 1, 2, 3, 6, 7, 8, 11-15).

One technique that can be applied to constrain the lower end 32 of the elastic metal sheet 17 to the strut 20 can be to co-inject or super-inject on the lower end 32 a plastic material with good mechanical and rigidity properties, such as polyurethane, Delrin or other similar materials, which constitutes the strut 20.

In a variant form of embodiment, the command mechanism 22 consists of a lever 19 pivoted by a pin 18 and acting on the elastic metal sheet 17, in particular on the lower end 32, or on the strut 20 associated thereto.

In some forms of embodiment, the lever 19 is configured to cooperate with the cuff 13 and to act on the elastic metal sheet 17 so as to provide it with a position in which the lower end is distant from and does not cooperate with the shell 12, and a position in which the lower end 32 cooperates with the stepped stopping surface 21.

The lever 19 can be pivoted directly on the elastic metal sheet 17, providing pivoting eyelets made on the latter; or the lever 19 can be pivoted on a pivoting portion made on the external rear surface 15 of the cuff 13; or again, the lever 19 can be pivoted directly on the strut 20, when provided.

In a variant form of embodiment, the lever 19 has a gripping or maneuvering portion 23 and a lower cam portion 24 able to contact directly the lower end 32 of the elastic metal sheet 17, or the lower end 42 of the strut 20, if provided. The rotation of the lever 19, as indicated by arrow G in FIGS. 1 and 2, and hence of the cam portion 24, determines a positive thrust toward the outside of the cuff 13 on the elastic metal sheet 17, or on the strut 20, if provided, to assume the second unclamped position.

In this position the cuff 13 and shell 12 can be reciprocally rotated and the use of the boot 10 is favored in the "walking" configuration, especially in the case of boots for Alpine skiing.

Advantageously, the cam portion 24 of the lever 19 is shaped with a flat segment 27 which, normally in the first clamped position, stably rests in abutment on the corresponding rear surface 15 of the cuff 13, in particular in a suitable supporting seating 26.

In this way, a limit position is defined in the opening rotation of the lever 19, in correspondence with which the articulation dead point of the lever 19 is exceeded. It is thus guaranteed that the closed condition of the lever 19 is maintained, until the user voluntarily actuates an opening action.

Figure 10:
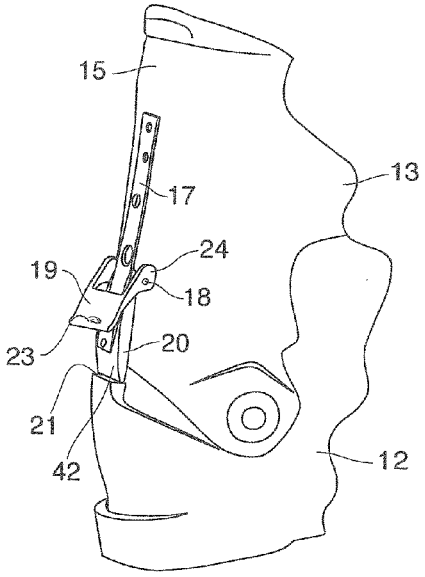
Figure 8:
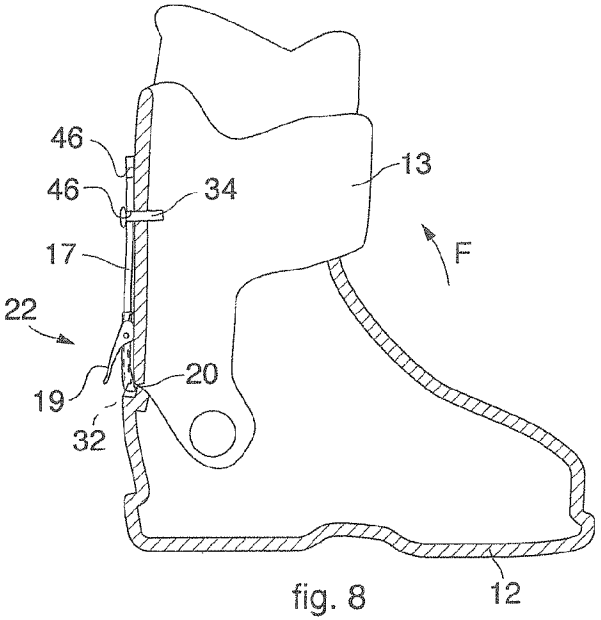
FIGS. 6, 7 and 8 are schematic sections of the variant boot in FIGS. 4 and 5 in successive adjustment conditions of the clamping device.

As shown in the attached drawings, the lever 19 can be of limited sizes (FIGS. 1-5), or bigger (FIG. 10). As can be seen from the attached drawings, the shape of the lever 19 can be varied as desired, according to functional and/or aesthetic needs.

Figure 9:
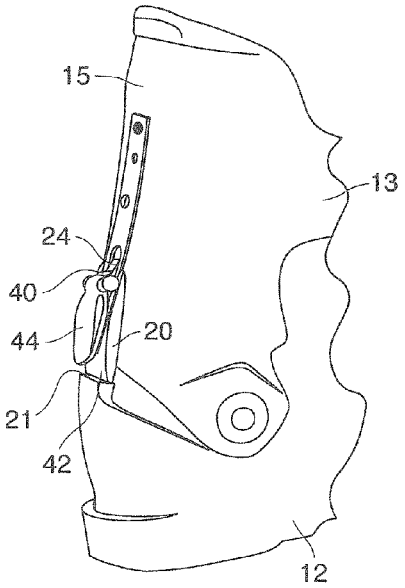
FIGS. 9 and 10 are partial perspective views of variants of the clamping device of the boot according to the present invention.

In another variant form of embodiment, the command mechanism 22 consists of a cam portion 24 interposed between cuff 13 and lower end 32 of the elastic metal sheet 17, or the lower end 42 of the strut 20, if provided, and by a band 40 which can be put under traction by a gripping element 44, determining the displacement and rotation of the cam portion 24 and therefore of the elastic metal sheet 17 (FIG. 9).

According to some variant forms of embodiment (FIGS. 4-8), the position of the elastic metal sheet 17 along the cuff 13 can be adjusted in height, so as to vary the angle of inclination of the main axis of the cuff 13 with respect to the support base of the shell 12 in the first clamped position adopted during sporting activity.

Figure 7:
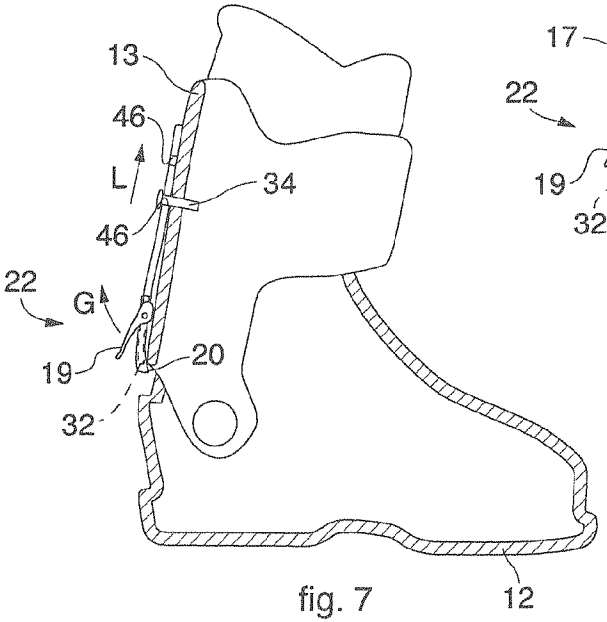
Figure 6:
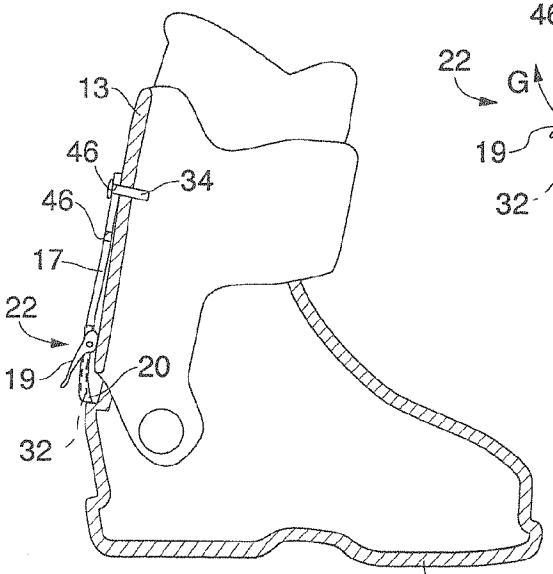
Figure 11:
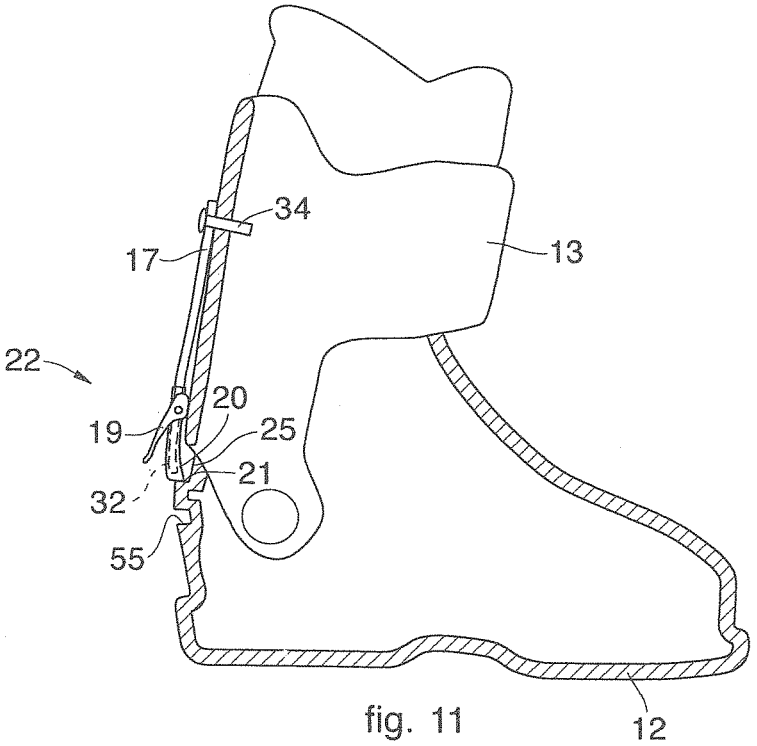
FIGS. 11 and 12 are schematic lateral sections of a variant of the boot according to the present invention in a first clamped position of use and a second unclamped position of use.

To this purpose, the elastic metal sheet 17 may have a plurality of adjustment holes 46 disposed longitudinally, so as to affect a determinate segment of the external rear surface 15 of the cuff 13, which cooperate on each occasion with the attachment means 34. By selecting a desired one of the adjustment holes 46, it will be possible to adjust the position of the elastic metal sheet 17, raising it or lowering it according to requirements. In particular, FIG. 6 shows the boot 10 in a first clamped position, for example with an inclination of about 25° and with the first upper hole 46 engaged to attach the elastic metal sheet 17 at a determinate height. FIG. 7 shows how the elastic metal sheet 17 is raised, as indicated by arrow L in FIGS. 5 and 7, and the second hole 46 is engaged and the cuff 13, since the clamping device 11 is displaced upward, is dis-engaged from the shell 12 and can be rotated to close the angle of inclination. FIG. 3 shows the final condition, where the angle of inclination is reduced, for example to about 15°, and the cuff 13 is again clamped to the shell 12.

Figure 12:
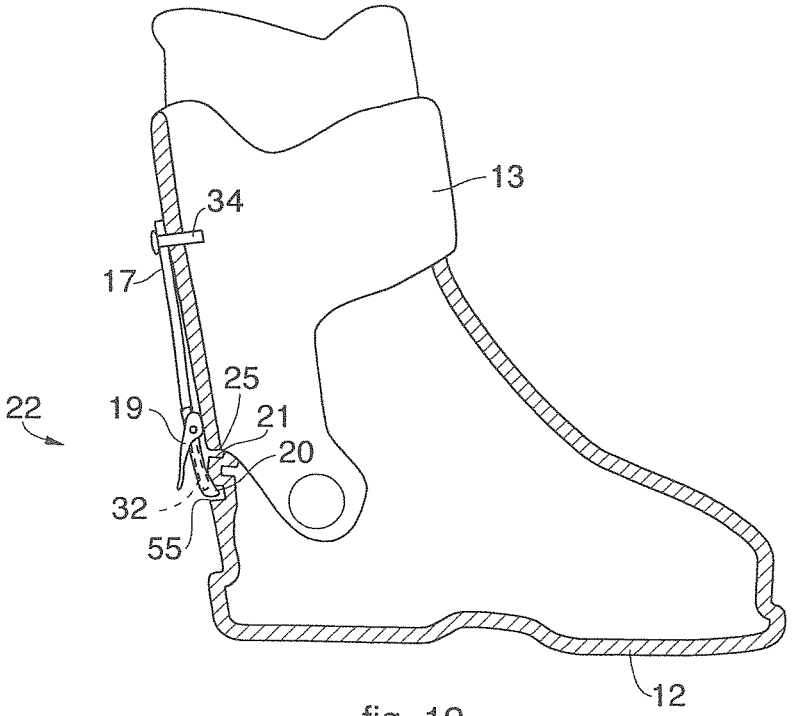

According to some forms of embodiment of the present invention, in the second position the lower end 32 of the elastic metal sheet 17, or the lower end 42 of the strut 20, if provided, can remain free, that is, unconstrained, so as to allow oscillation. However, there may be a variant of another clamping seating 55 (FIGS. 11 and 12), made in the shell 12 below the clamping seating 25, in which the lower end 32 of the elastic metal sheet 17 or the lower end 42 of the strut 20, if provided, can be inserted and clamped. In this way, it is possible to define a third clamped position of use, different from the first and second position, with a desired angular configuration of cuff 13 and shell 12. This variant allows to vary the specific walking condition and to fix it in the determinate position (FIG. 12).

Figure 15:
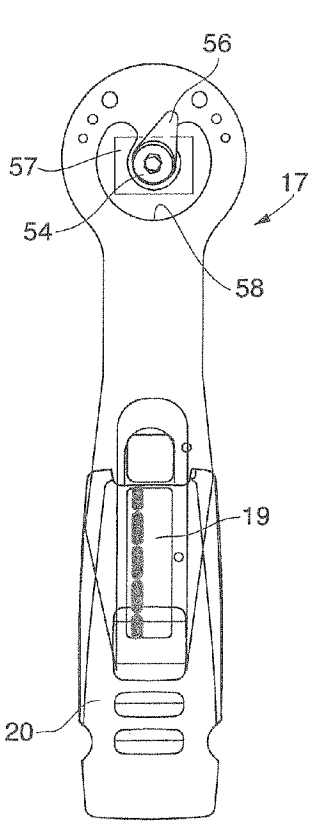
FIG. 15 is another variant of a part of the clamping device of the boot according to the present invention.
Figure 14:
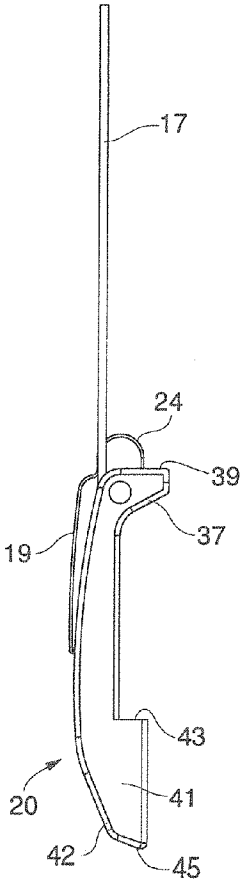
FIG. 14 is a lateral view of part of FIG. 13.
Figure 13:
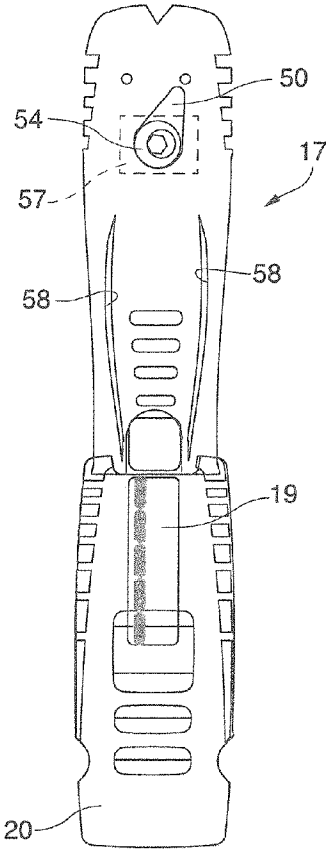
FIG. 13 is a variant of a part of the clamping device of the boot according to the present invention.

FIGS. 13, 14 and 15 show other specific variants of the elastic metal sheet 17, in this case coupled with a strut 20 made of plastic material co-injected to the lower end 32. In these variants, moreover, the lever 19 is provided by way of example with the cam portion 24.

In these variants, the mechanical attachment mechanism that cooperates with the upper end 30 of the elastic metal sheet 17 may also consist of a mechanism 54 to adjust the rigidity of the cuff 13, in particular that adjusts the bending of the cuff 13 in a front direction.

The adjustment mechanism 54 both constrains the elastic metal sheet 17 to the cuff 13 by means of a rivet, pin, peg or suchlike, and is also provided with a rotating rectangular adjustment block or plate 57, generally consisting of pads that selectively cooperate with elements made in relief on the cuff 13, drivable by a swivel lever 56 and which can assume several positions cooperating with the surface of the cuff 13 itself, freeing or clamping the cuff 13 and thus rendering the behavior of the cuff 13 more or less rigid.

With this variant form of embodiment, therefore, the present invention combines and integrates two types of adjustment, that is, angular position of cuff 13 and shell 12 and rigidity of the cuff 13, in the single element represented by the elastic metal sheet 17 of the clamping device 11.

In particular, in FIGS. 13 and 14 the elastic metal sheet 17 has one or more through notches 58 that improve the properties of flexibility and elastic response during use. Preferably, the notches 58 are made along the lines of force acting on the elastic metal sheet 17 when a force of traction is applied on it toward the outside. The notches 58 can therefore function as means to concentrate force, in order to facilitate the clamping/unclamping operations. In the variant shown in FIG. 13, the notches 58 develop longitudinally, slightly curved so as to promote the desired concentration of the stress, from the lower end 32 toward the lower zone in correspondence with the adjustment mechanism 54. On the contrary, in the variant shown in FIG. 15, the notches 58 develop around the adjustment mechanism 54 along an open path.

FIG. 14 shows another variant form of embodiment of the strut 20, solid with the elastic metal sheet 17, in this case with the lower end 32 incorporated in the strut 20.

In this variant, the strut 20 has an upper end 37, shaped to define a first upper undercut 39 that cooperates in abutment with a determinate clamping surface of the cuff 13, while the lower end 42 is shaped with an increased section and with a configuration that defines a second undercut 43 that cooperates in abutment with a determinate portion of the cuff 13, and a lower edge 45 that rests on the stepped stopping surface 21 of the shell 12.

Therefore, the first undercut 39 and the second undercut 43 define a stable upper and lower support and clamping for the strut 20 with respect to the cuff 13. In this way, in the first clamped position, the strut 20 is clamped between cuff 13 and shell 12. Furthermore, since the increased section 41 of the strut 20, in the first position, is clamped between the two surfaces respectively of the cuff 13 and the shell 12, the lower end 42 is inserted wedge-wise and gripped between the corresponding parts of the cuff 13 and shell 12, optimally discharging the stresses that occur during sporting activities.

The invention claimed is:

1. A sport footwear comprising a lower part or shell to contain the foot, and an upper part or cuff to contain and surround the joint of the ankle and the lower part of the leg, the cuff and shell being pivoted with respect to each other, a clamping device being provided for the reciprocal clamping of the cuff and the shell at least in a first clamped position and a second unclamped position, in which the free oscillatory movement of the cuff and shell is allowed, wherein the clamping device comprises:

an elastic metal sheet anchored directly to and on the cuff, which develops longitudinally along an external rear surface of the cuff and configured to act as a selective clamping element of the reciprocal angular position of cuff and shell, said elastic metal sheet having at least a lower end free and for selective clamping;

a stepped stopping surface present on the rear of the shell and which delimits a clamping seating shaped mating with the lower end, said lower end of the elastic metal sheet being configured to act, in the first clamped position, in cooperation with the stepped stopping surface;

a command mechanism associated externally to the cuff and configured to condition the position of the elastic metal sheet and thus to take said elastic metal sheet from the first clamped position to the second unclamped position and vice versa, said command mechanism comprising a lever configured to cooperate with the cuff and to act on said elastic metal sheet so as to provide said elastic metal sheet with a position in which said lower end is far from and does not cooperate with the shell, and a position in which said lower end cooperates with said stepped stopping surface.

2. The sport footwear as in claim 1, wherein the elastic metal sheet is shaped like a band, or strip, with an oblong development with reduced thickness and is made using a metal with elastic properties which include harmonic steel for springs.

3. The sport footwear as in claim 1, wherein the elastic metal sheet has an upper attachment end, stably constrained to an upper segment of the rear surface of the cuff, and wherein the lower end is configured to be elastically deformed between the first clamped position, displaced toward the inside of the cuff, in which said lower end constrains the reciprocal movement of the cuff and the shell, and the second unclamped position, displaced toward the outside of the cuff, in which said lower end allows the oscillation of the cuff and shell.

4. The sport footwear as in claim 3, wherein the clamping device comprises attachment means to constrain the upper end of the elastic metal sheet to the upper segment of the rear surface of the cuff, which include mechanical attachment means, or adjustment means to adjust the rigidity of the cuff.

5. The sport footwear as in claim 1, wherein the command mechanism comprises a cam portion acting on the elastic metal sheet.

6. The sport footwear as in claim 5, wherein the cam portion is shaped with a flat segment which, in the first clamped position, stably rests in abutment on the corresponding rear surface of the cuff.

7. The sport footwear as in claim 1, wherein the command mechanism comprises a band and a gripping element.

8. The sport footwear as in claim 1, wherein the elastic metal sheet is the only element making up the clamping device that is able to cooperate with the stepped stopping surface.

9. The sport footwear as in claim 1, wherein the elastic metal sheet is coupled to a stopping element or strut, disposed substantially longitudinally along the external rear surface of the cuff, selectively mobile solid with the elastic metal sheet between a first clamped position, in which said stopping element or strut reciprocally clamps the cuff and the shell, and a second unclamped position, displaced toward the outside of the cuff with respect to the first position, in which said stopping element or strut allows the free oscillatory movement of the cuff with respect to the shell.

10. The sport footwear as in claim 9, wherein the elastic metal sheet can be attached, incorporated or partly drowned in the strut.

11. The sport footwear as in claim 1, wherein the elastic metal sheet has adjustment holes by means of which to adjust in height the position of the elastic metal sheet along the rear surface of the cuff.

12. The sport footwear as in claim 1, wherein the clamping device has a clamping seating configured to cooperate with the elastic metal sheet to define a third clamped position of use, different from the first and second position.

13. The sport footwear as in claim 1, wherein the elastic metal sheet has one or more through notches.

* * * * *